United States Patent [19]

Houston

[11] Patent Number: 4,966,086

[45] Date of Patent: Oct. 30, 1990

[54] WATER COOLED INCINERATOR

[76] Inventor: Clarence H. Houston, 327 Delia Street, Orillia, Ontario, Canada, L3V 1H1

[21] Appl. No.: 482,871

[22] Filed: Feb. 21, 1990

[30] Foreign Application Priority Data

Feb. 22, 1989 [CA] Canada ..... 591780

[51] Int. Cl.[5] ..... F23J 15/00

[52] U.S. Cl. ..... 110/215; 110/216; 110/234; 110/248; 110/180

[58] Field of Search ..... 110/215, 216, 234, 248, 110/259, 180

[56] References Cited

U.S. PATENT DOCUMENTS 1,101,925 6/1914 Harris .
1,803,206 4/1931 Owens .
1,952,389 3/1934 Staples .
4,167,146 9/1979 Wirth .
4,444,127 4/1984 Spronz .
4,625,661 12/1986 Melcheiv ..... 110/345
4,718,357 1/1988 Wang et al. .
4,726,302 2/1988 Hein et al. ..... 110/345

*Primary Examiner*—Henry C. Yuen

[57] ABSTRACT

An incinerating device of metallic construction comprises a combustion chamber in which waste material is incinerated, a gas-scrubbing chamber in which the combustion gases are washed with water sprays to remove particulate material. The washed gases are vented to the atmosphere and the scrubbing water passes downwardly through a series of metallic mesh filter trays in a filter tower to remove particulate material from that water which is then recirculated to the scrubbing chamber. The walls and roof of the combustion chamber are formed as hollow metallic structures defined by inner and outer metallic members and cooling water flows continuously through those hollow structures to reduce thermal damage thereto.

12 Claims, 5 Drawing Sheets

WATER COOLED INCINERATOR

FIELD OF THE INVENTION

The present invention relates to incinerating devices of metallic construction.

BACKGROUND OF THE INVENTION

With the growing social concern about the disposal of ever-increasing amounts of garbage and other waste material, the need for effective incinerating devices has increased correspondingly.

Many types of incinerating devices are already known but such devices are extremely expensive and have limited useful operating lives particularly when they are operated at the high temperatures required for the destruction or deactivation of toxic waste materials. For example, known incinerating devices with walls constructed of fire-brick or other refractory material are eventually thermally degraded to such an extent that they must be rebuilt, simple repair eventually becoming impossible. Clearly, such reconstruction is extremely expensive and, during such reconstruction, waste material awaiting incineration accummulates presenting yet additional problems.

It is accordingly an object of this invention to provide an incinerating device of metallic construction for the aforesaid purposes and which device has a longer useful operating device than those previously known.

It is a further object of this invention to provide an incinerating device of metallic construction and in which the thermal degradation of structural parts thereof is significantly reduced.

Yet another object of this invention is to provide an incinerating device of metallic construction and in which the replacement of structural components thereof when eventually required is facilitated thereby delaying the need for total or at least extensive reconstruction of the device.

A further object of the invention is to provide an incinerating device of metallic construction and which is constructed in such a manner that the replacement of structural parts can be effected much more quickly and at a much lower cost than with the incinerating devices heretofore known.

Other objects of the invention and the advantages presented thereby will become apparent as the description herein proceeds.

SUMMARY OF THE INVENTION

Broadly, the present invention provides an incinerating device of metallic construction and which comprises a combustion chamber having upstanding metallic wall structures, each being formed by mutually spaced apart inner and outer metallic wall members and an overhead metallic roof structure formed by mutually spaced apart upper and lower metallic roof members; a metallic door structure mounted on said combustion chamber for movement between a closed position and an open position for the introduction into said combustion chamber of material to be incinerated and formed by mutually spaced apart inner and outer metallic door members; a hearth means within said combustion chamber for supporting material being incinerated within said chamber; burner means associated with said hearth means within said combustion chamber for incinerating material within said chamber; fuel supply means connected to said burner means for supplying fuel thereto; grate means within said combustion chamber below said hearth means for receiving solid combustion products during incineration of material within said combustion chamber; at least one cooling water supply means associated with said combustion chamber for supplying water to the spaces between said inner and outer wall members, the space between said upper and lower roof members and the space between said inner and outer door members; at least one cooling water discharge means associated with said combustion chamber for discharging cooling water after its passage through the spaces between said inner and outer wall members, the space between said upper and lower roof members and the space between said inner and outer door members of said combustion chamber; at least one first recirculating means for recirculating cooling water from said cooling water discharge means to said cooling water supply means; a gas-scrubbing chamber connected to said combustion chamber for receiving combustion gases therefrom; water spray means in said gas-scrubbing chamber for discharging water through said combustion gases passing through said gas-scrubbing chamber; scrubbing water supply means associated with said water spray means for supplying gas-scrubbing water thereto; filter tower means connected to said gas-scrubbing chamber for receiving both scrubbed combustion gases and scrubbing water from said gas-scrubbing chamber at an upper end of said filter tower means; gas discharge means at an elevated position in said filter tower means for the discharge of scrubbed combustion gases from said filter tower means; filter means in said filter tower means for filtering scrubbing water falling downwardly therethrough; scrubbing water discharge means in said filter tower means for the discharge of filtered scrubbing water therefrom; second recirculating means connecting said scrubbing water discharge means in said filter tower means to said scrubbing water supply means for transporting filtered scrubbing water to said water spray means; flushing means associated with said filter means for discharging water to said filter means to dislodge solid material therefrom; and waste water discharge means in said filter tower for discharging waste water containing solid material therefrom.

In accordance with a preferred feature of this invention, the inner and outer wall members, said upper and lower roof members and said inner and outer door members of the combustion chamber of such an incinerating device are all formed from a sheet metal material.

The door structure of an incinerating device in accordance with this invention is conveniently pivotally mounted in one of said wall structures of the combustion chamber for movement between said open and closed positions. For example, the door structure can be pivotally mounted in one of the wall structures of the combustion chamber for movement between a generally vertical closed position and a lowered open position in which it provides a loading ramp for discharging the material to be incinerated into the combustion chamber.

The grate means provided in an incinerating device in accordance with this invention is usefully adapted for movement between a closed position for supporting solid combustion products thereon and an open position permitting such solid combustion products to fall downwardly therethrough.

Such a grate means usefully comprises a plurality of grate bars pivotally mounted for movement between first positions in which first surfaces of those grate bars cooperate to provide a surface for supporting solid combustion products thereon and second positions in which such surfaces are inclined to provide discharge openings between the grate bars.

The gas-scrubbing chamber of an incinerating device in accordance with this invention usefully has a structure sloping downwardly toward the filter tower means whereby the scrubbing water flows gravitationally to the filter tower means.

Such gas-scrubbing chamber is usefully of metallic construction and is defined by metallic wall structures each being formed by mutually spaced apart inner and outer metallic wall members, a metallic roof structure formed by mutually spaced apart upper and lower metallic roof members and the base structure is usefully in turn formed by mutually spaced apart upper and lower metallic base members, the spaces between the inner and outer wall members, the upper and lower roof members and the upper and lower base members of the gas-scrubbing chamber being associated with the cooling water supply means and the cooling water discharge means for the passage of cooling water through those spaces. Usefully, a blower means is provided to drive the combustion gases through the gas-scrubbing chamber.

In an incinerating device in accordance with this invention, the filter means advantageously comprises a plurality of downwardly sloping and vertically spaced apart filter trays disposed so that scrubbing water flows sequentially across and downwardly through those trays falling downwardly from each such filter tray to the next tray therebelow, such filter trays being effective to separate solid material from the scrubbing water flowing therethrough.

In accordance with a preferred feature of this invention, an incinerating device in accordance therewith usefully also comprises heat exchanger means in the first recirculating means for cooling water flowing therethrough.

The various features of novelty which characterize the invention are pointed out with more particularity in the claims annexed to and forming a part of this disclosure. For a better understanding of the invention, its operating advantages and the specific objects attained by its use, reference should be had to the accompanying drawings and descriptive matter in which there is illustrated and described a preferred embodiment of the invention.

BRIEF DESCRIPTION OF THE DRAWINGS

The invention will now be described merely by way of illustration with reference to the accompanying drawings in which.

DESCRIPTION OF THE PREFERRED EMBODIMENT

Figure 1:
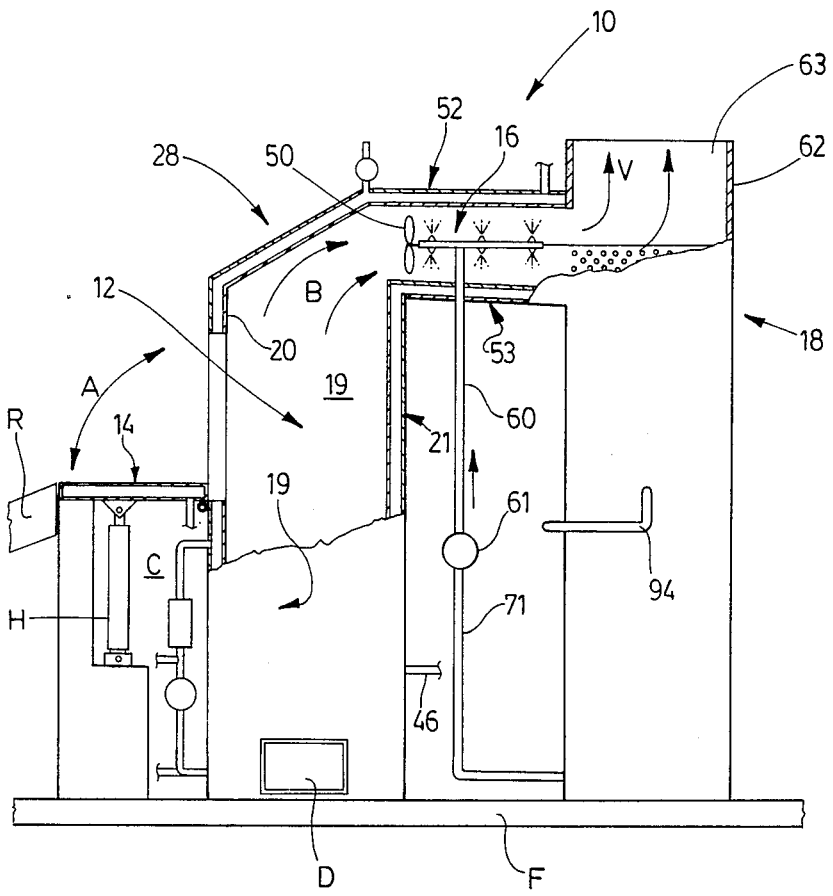
FIG. 1 is a schematic illustration showing the overall structure of one embodiment of an incinerating device in accordance with this invention with several component parts omitted for the sake of clarity.

The incinerating device generally indicated at 10 in FIG. 1 comprises a combustion chamber generally indicated at 12, a door structure generally indicated at 14, a gas-scrubbing chamber generally indicated at 16 and a filter tower means generally indicated at 18. The device 10 is shown as being erected on a footing or foundation F.

Figure 2:
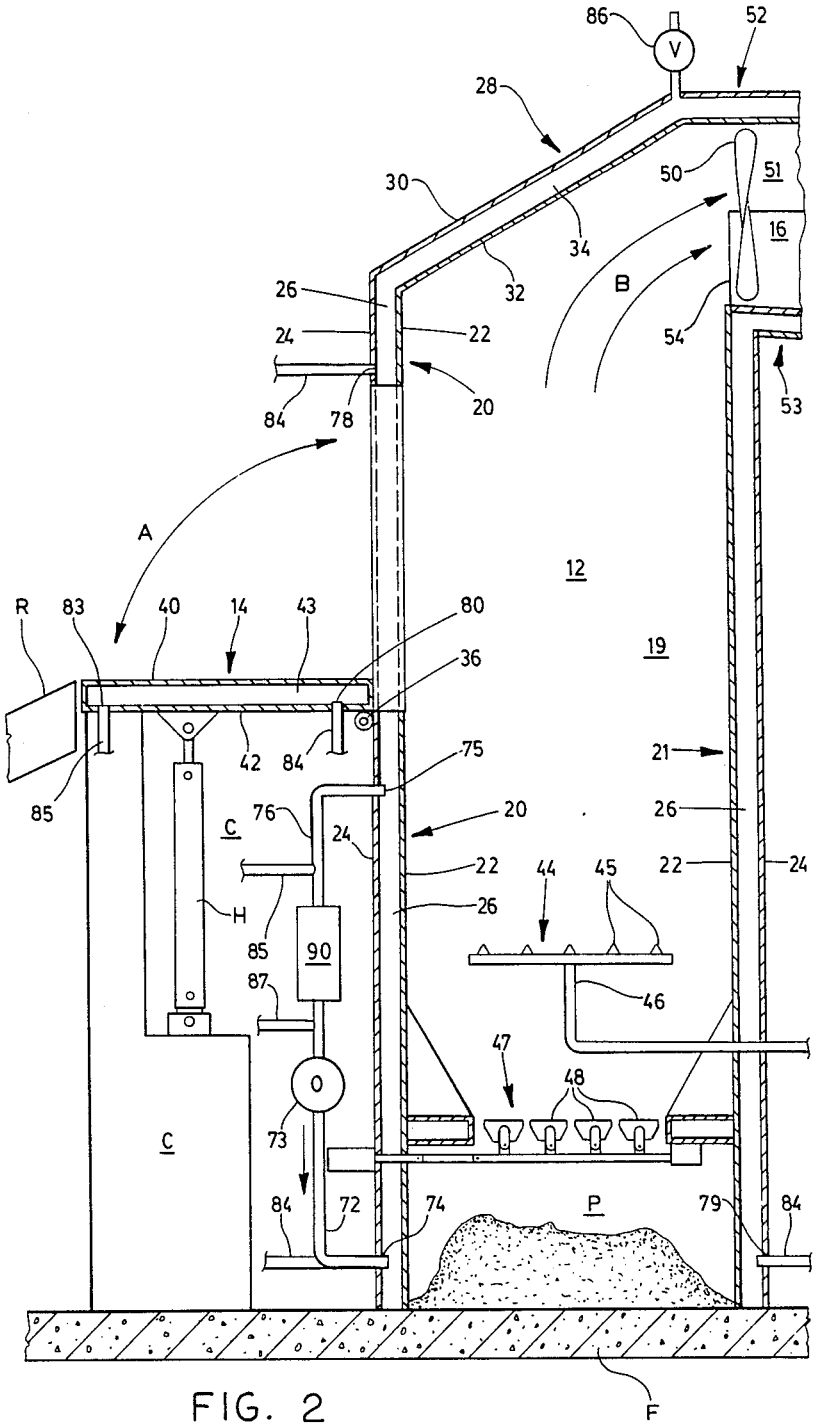
FIG. 2 is a partial vertical sectional view through the incinerating device of FIG. 1.

The combustion chamber 12 comprises four upstanding wall structures, namely front and rear wall structures 19 and two side wall structures shown at 20 and 21 in both FIGS. 1 and 2. Each of the four wall structures comprises an inner wall member 22 and an outer wall member 24. The wall members 22 and 24 are mutually spaced apart to provide spaces 26 therebetween. The combustion chamber 12 also comprises a roof structure generally indicated at 28 and formed from mutually spaced apart upper and lower roof members 30 and 32 respectively defining therebetween a space indicated at 34.

At a suitable vertical position within the wall structure 20, there is pivotally mounted, as indicated schematically at 36, the door structure 14 comprising mutually spaced apart inner and outer door members 40 and 42 respectively defining therebetween a space generally indicated at 43.

The door structure 14 can be moved as indicated by the double-headed arrow "A" between a lowered open position as shown in solid lines in FIGS. 1 and 2 and a generally vertical closed position shown in phantom outline in FIG. 2. Movement of the door structure 14 between these two positions is shown, by way of example, as being controlled by a hydraulic mechanism schematically indicated at H and housed within a compartment C alongside a lower part of the wall structure 20. In its generally horizontal lowered position, the door structure 14 is aligned with an access ramp R to provide a loading ramp by means of which material to be incinerated can be introduced into the combustion chamber 12.

The inner and outer wall members 22 and 24 of the wall structures 19, 20 and 21, the inner and outer door members 40 and 42 of the door structure 14 and the upper and lower roof members 30 and 32 of the roof structure 28 are all usefully formed of sheet metal. While no specific structural details are shown in the drawings, it will be understood that a structural framework including suitable bracing members will be provided for supporting such wall members, door members and roof members in their spaced apart positions. Since such structural members form no part of the present invention, they are omitted from the drawings to facilitate comprehension thereof. It should perhaps, however, be emphasized that such framework will be such as to provide adequate structural strength to the various structures without, however, significantly impeding the flow of cooling water through the spaces 26, 34 and 43 in a manner yet to be explained.

Within the combustion chamber 12, there is provided in a conventional manner a hearth means schematically and generally indicated at 44. Such hearth means 44 has associated therewith a burner means including nozzles 45 supplied with a combustible fuel, such as oil or gas, through a fuel supply means or pipe shown fragmentarily at 46. It will also be understood that the fuel supply means 46 will be provided in a conventional manner with fuel supply control means (not shown) such as a fuel valve and that an ignition device (not shown) will generally be provided, again in a conventional manner, at the hearth means 44.

Below the hearth means 44, there is provided within the combustion chamber 12, a grate means generally indicated at 47. The grate means 47 serves to receive and support solid combustion products, such as ash, produced during incineration of material within the combustion chamber 12.

In accordance with a particularly useful feature of this invention, the grate means 47 is constructed so that it can have both an ash-supporting position and an ash-discharging position. In the latter position, such ash can fall through the grate means 47 into an ash pit P (FIG. 2) from which such ash can be removed through an access door indicated schematically at D (FIG. 1). Adjustment of the orientation of the grate means 47 also serves to vary the upward flow of combustion air to the material being incinerated.

Figure 5:
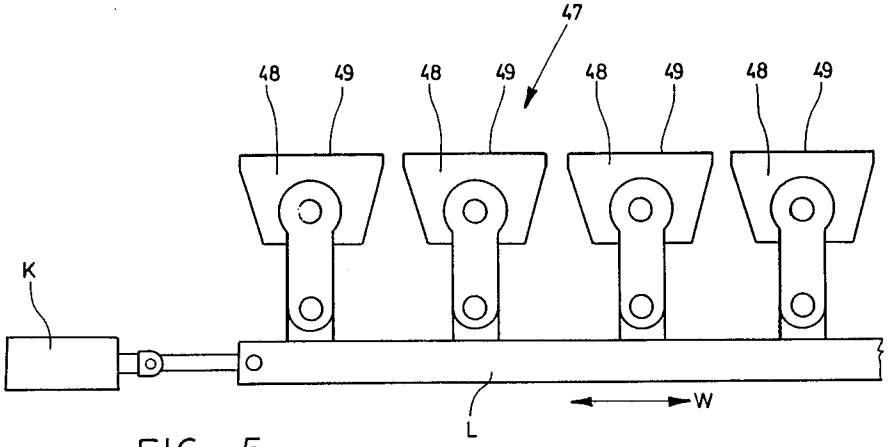
FIG. 5 is a fragmentary schematic elevation of one construction for a grate means as used in the incinerating device shown in FIGS. 1 to 4 with that grate means in its ash-supporting position.
Figure 6:
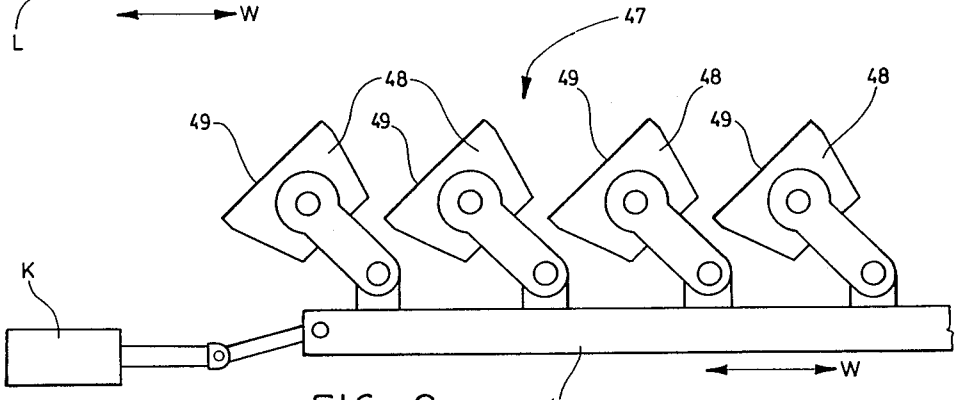
FIG. 6 is a fragmentary schematic elevation similar to that of FIG. 5 but showing the grate means in its ash-discharging position.

One typical construction for such a preferred grate means is shown in greater detail in FIGS. 5 and 6 from which it will be seen that the grate means 47 comprises a plurality of mutually spaced grate bars 48 having surfaces 49 and which are pivotally mounted as shown somewhat schematically for movement between first positions (FIG. 5) in which said surfaces 49 cooperate to provide a surface for supporting the solid combustion products and second positions (FIG. 6) in which the surfaces 49 are inclined so to permit discharge of such ash through the spaces between the grate bars.

In FIGS. 5 and 6, movement of the grate bars 48 between their open and closed positions is illustrated schematically as being controlled by a hydraulic cylinder K and push rod L, the latter moving as indicated by the double-headed arrow W. It will of course be understood that other mechanisms can be used to obtain such movement of the grate bars.

From the combustion chamber 12, combustion gases resulting from the incineration of materials in that chamber pass as indicated by the arrows B into the gas scrubbing chamber 16. Usefully, a fan 50 is provided to drive the combustion gases through the scrubbing chamber 16. It will be understood that suitable drive means (not shown) will be provided for the fan 50. The scrubbing chamber 16 is defined by front and rear wall structures generally indicated at 51, a roof structure generally indicated at 52 and a base structure generally indicated at 53. Upwardly, of the base structure 53, there is usefully provided a generally semi-cylindrical collector tray 54 for a purpose yet to be explained. The structures 51, 52 and 53 are usefully also formed of mutually spaced apart inner and outer members 55 and 56 respectively to define therebetween spaces indicated at 57.

Within the gas-scrubbing chamber 14, there is provided a water spray means schematically indicated at 58 and provided with nozzles 59 for discharging or spraying water through the combustion gases passing through that chamber 16. The spray means 58 is shown as being supplied with water through a supply means or conduit 60 by a pump 61 and in a manner to be described in greater detail as the description herein proceeds.

It will be noted that, in accordance with a preferred feature of this invention, the collector tray 54 in the gas-scrubbing chamber 16 slopes downwardly toward the filter tower 18 to permit the scrubbing water to flow gravitationally to that tower 18.

The collector tray 54 usefully extends into the filter tower 18 and, within that tower is perforated to provide discharge openings 67.

In the particular embodiment shown in the accompanying drawings, the filter tower 18 comprises upstanding walls 62 supported on the footing F. The upper end of the tower 18 is open as indicated at 63 to provide a gas discharge means so that scrubbed combustion gases entering the filter tower 18 from the gas-scrubbing chamber 16 can be vented from that tower as indicated by the arrows V.

Within the filter tower 18, there are usefully provided a series of downwardly sloping and vertically spaced apart filter trays 64 formed of metallic meshing so that scrubbing water entering the tower 18 from the gas-scrubbing chamber 16 flows through the opening 67 in the collector tray 54 and then sequentially across and downwardly through those filter trays 64. If desired, an imperforate deflector plate 68 can be provided immediately below the collector tray 54 to cause the water discharging through the openings 67 to be diverted to the upper end of the uppermost filter tray 64.

Between the filter trays 64, there are provided perforated floors 65 formed with holes 66. The scrubbing water falls from a filter tray 64 and onto the floor 65 immediately therebelow and then flows through the holes 66 therein onto the next lower filter tray 64. It should be noted that the floors 65 do not provide a filtering action since the holes 66 therein are sufficiently large to permit the unrestricted flow of solids and water. The filter trays 64 and the floors 65 are secured to the walls 62 by any appropriate means (not shown).

Near to the base of the filter tower, there is provided an imperforate collector tray 69 which slopes downwardly to a central discharge outlet 70 connected to a discharge conduit 71 for recirculating scrubbing water to the pump 61.

Figure 3:
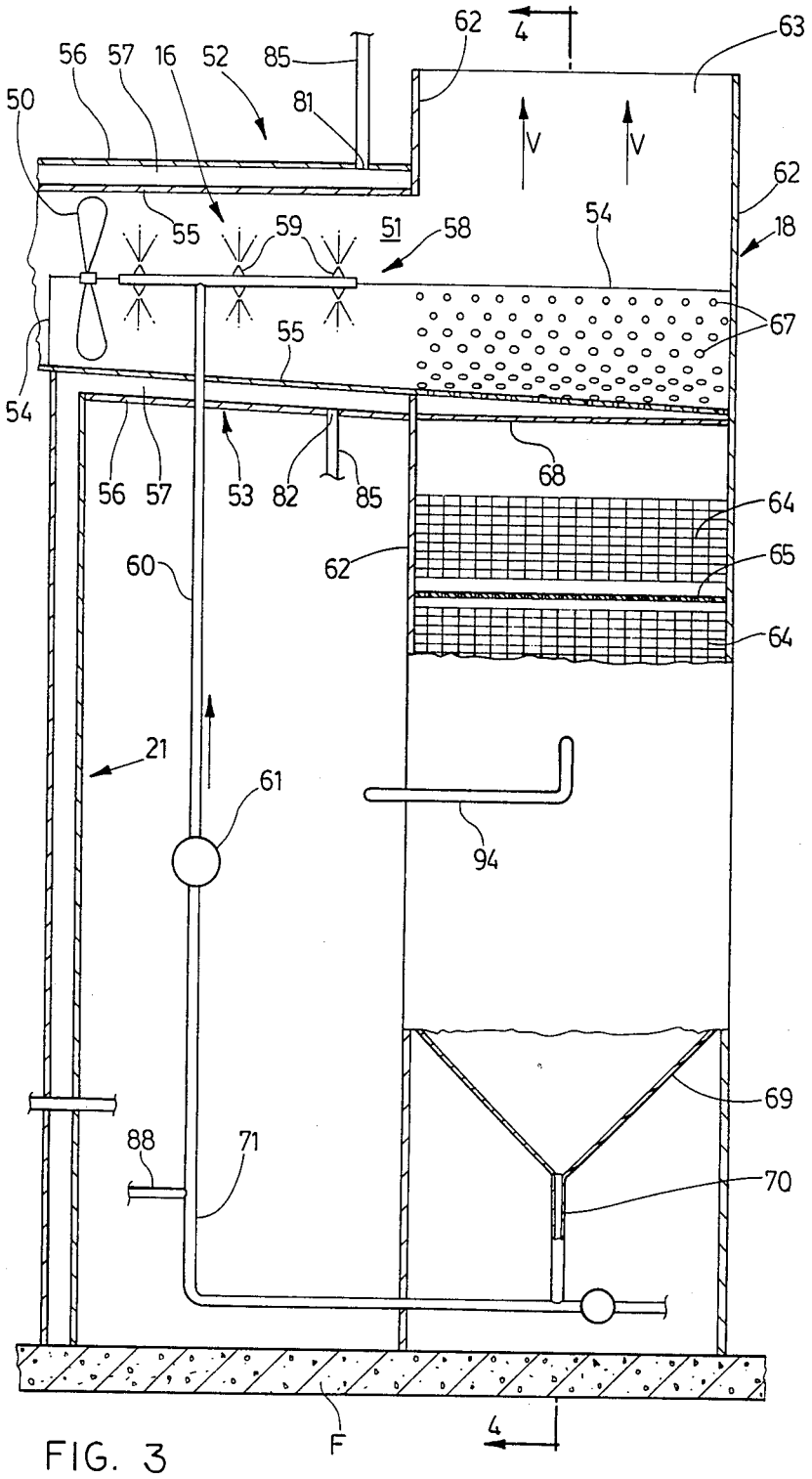
FIG. 3 is a further partial vertical view of the incinerating device of FIG. 1 with certain parts shown in section.

The incinerating device 10 shown in FIGS. 1 to 3 is also provided with means for cooling the wall structures, such as wall structures 19, 20 and 21, the roof structure 28 and the door structure 14 of the combustion chamber 12 as well as the wall structures 51, the roof structure 52 and the base structure 53 of the gas-scrubbing chamber 16.

For this purpose, there is provided at least one cooling water supply means or conduit 72 which is adapted to provide cooling water to the spaces within the aforementioned structures. In the particular embodiment illustrated, the supply conduit 72 is shown as being provided with cooling water by a pump 73. In FIG. 2, the supply conduit 72 is shown as being connected to a water inlet 74 in the lower part of the wall structure 20 below the door structure 14. Such cooling water flows upwardly through the space 26 between the inner and outer wall members 22 and 24 respectively of that lower part of the wall structure 20 and discharges from that space through a discharge outlet 75 for recirculation through a conduit 76 to the pump 73.

While separate cooling water supply conduits, discharge conduits and recirculating pumps can be provided for the several hollow structures hereinbefore enumerated, the device 10 is shown in FIG. 2 as being provided with a single recirculating system additionally comprising cooling water inlets 78, 79 and 80 and cooling water discharge outlets 81, 82 and 83.

The inlet 78 is shown as being provided in the upper part of the wall structure 20 of the combustion chamber 12 above the door structure 14 and the outlet 81 is shown as being provided in the roof structure 52 of the gas-scrubbing chamber 16 for the flow of cooling water upwardly through the upper part of the combustion chamber wall structure 20, through the roof structure 28 of the combustion chamber 12 and then through the roof structure 52 of the gas-scrubbing chamber 16.

Similarly, the inlet 79 and outlet 82 are provided for the flow of cooling water through the wall structure 21 of the combustion chamber 12 and through the base structure 53 of the gas-scrubbing chamber 16.

Inlet 80 and outlet 83 are similarly provided for cooling of the door structure 14. It will be appreciated that similar inlets and outlets will be provided for the other wall structures of the combustion chamber 12 and for the wall structures of the gas-scrubbing chamber 16.

The water inlets 78, 79 and 80 are shown as being supplied with cooling water through conduits 84 (shown fragmentarily) which are coupled to the aforementioned supply conduit 72. Similarly, the discharge outlets 81, 82 and 83 are shown as discharging the cooling water into conduits 85 (shown fragmentarily) which are coupled to the aforementioned discharge conduit 76. It will now be understood that, in this particular embodiment, the pump 73 is used to effect circulation of cooling water (not shown) through all the aforementioned hollow structures. As previously indicated, it is also within the scope of this invention to provided separate cooling water systems for such separate hollow structures.

Usefully, steam release valves, one of which is indicated at 86, can be provided, either in such hollow structures, as shown, for the roof structure 28 of the combustion chamber 12, or in appropriate ones of the water discharge conduits, such as in conduits 85. Additionally, a make-up water supply conduit 87 can be connected to the system to replace from a suitable source any water which is lost during operation of the device 10. Similarly, a make-up supply conduit 88 can be provided in the scrubbing water system.

Depending upon the operating temperature of the incinerating device 10 and the spacings between the structural members of the various hollow structures, it may sometimes be necessary to provide heat exchanger means as indicated at 90 to ensure adequate cooling of the various components of the incinerating device.

Figure 4:
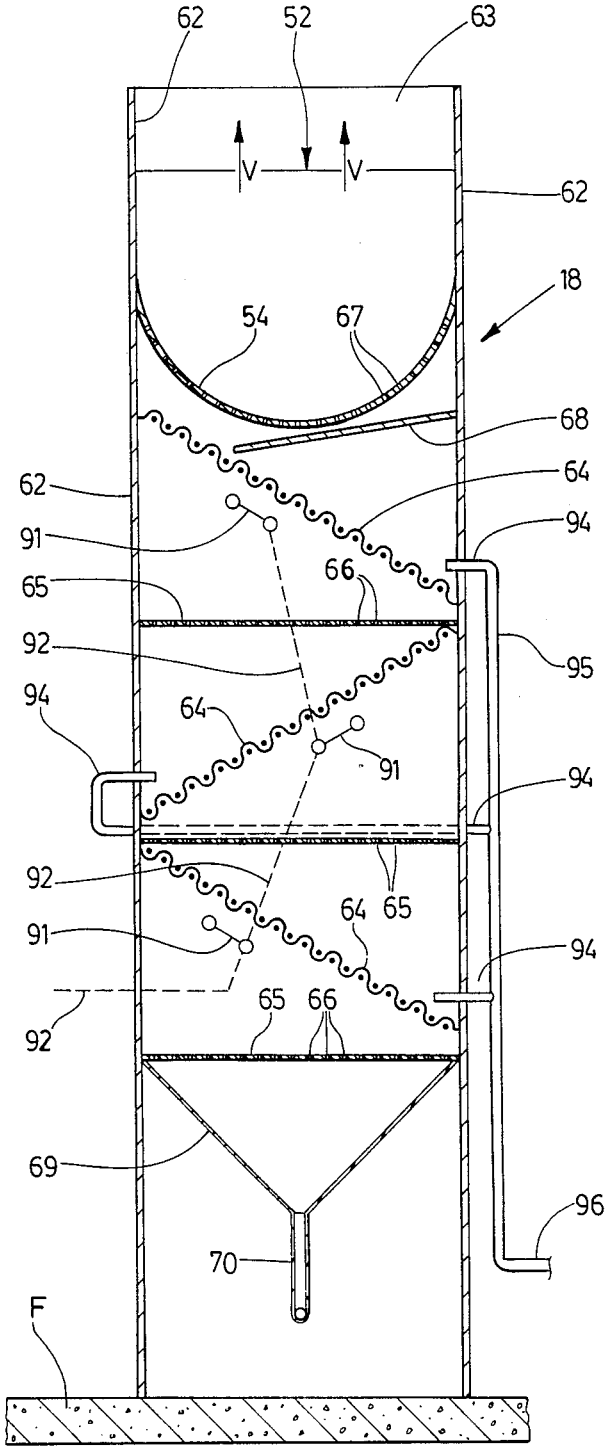
FIG. 4 is a vertical sectional view when taken as indicated by the arrows 4—4 of FIG. 3.

Referring again to the filter tower 18, it will be seen from FIG. 4 that the filter trays 64 are provided with flushing means for discharging water to those trays for the purpose of dislodging solid material therefrom. In the particular embodiment, such flushing means comprises rotating spray heads indicated schematically at 91 in FIG. 4 and omitted from FIG. 3. Such spray heads 91 are supplied with water through a supply conduit indicated schematically at 92 and which function to spray water upwardly through the filter trays 64. Discharge conduits 94 are provided for each of the filter trays 64 to receive flushing water containing solid material so dislodged from the filter trays 64 for eventual discharge through a main drain conduit 95 leading to drain 96. A drain outlet 97 will usefully be provided in the discharge conduit 71 to allow discharge of flushing water falling into the collector tray 69.

In operation of the incinerating device 10, waste or other material to be incinerated is introduced into the combustion chamber 12 with the door structure 14 in its open position as shown. After the introduction of such material into the combustion chamber 12, the door structure 14 is moved into its closed position as shown in phantom outline using, for example, the hydraulic mechanism H. The pumps 61 and 73 are then operated to provide respectively a gas-scrubbing water discharge from the nozzles 59 within the gas-scrubbing chamber 16 and cooling water circulation through the walls and other hollow structures of the combustion chamber 12 and the gas-scrubbing chamber 16 in the manner already described.

Fuel supplied to the burner nozzles 45 through the conduit 46 is then ignited so causing combustion of the material within the combustion chamber 12 with the resulting formation of solid combustion products such as ash which fall onto the grate means 47 and gaseous combustion products containing particulate material.

Such gaseous combustion products are blown through the gas-scrubbing chamber 16 by fan 50 as previously described wherein the gas-scrubbing water spray is effective to remove the particulate material from those gases. The combustion gases so scrubbed then pass into the filter tower 18 from which they are vented as indicated by the arrows V.

The scrubbing water then passes along the collector tray 54 and into the filter tower 18. In that tower, the scrubbing water flows downwardly through the openings 67 in the collector tray 54, downwardly across deflector plate 68, and then downwardly through the filter trays 64 and through the holes 66 in the floors 65, the particulate material in such water being retained on the filter trays 64. The scrubbing water with particulate material removed therefrom eventually reaches the collector tray 69 for discharge through the discharge outlet 70 and discharge conduit 71 and recirculation to the gas-scrubbing chamber 16 by the pump 61.

After an extended period of operation, the duration of which will vary according to the nature of the material being incinerated and on the incinerating conditions such as the incineration temperature, the mesh openings in the filter trays 64 will eventually become plugged with particulate material. At such time, the flushing system is operated to remove such particulate material from those trays. For this purpose, high pressure flushing water is discharged from the water rotating spray heads 91 upwardly through the filter trays 64. Mechanical drive means can be provided for rotating the spray heads 91 or their rotation can be caused automatically by reaction to the water discharge therefrom. Such water with the dislodged particulate material is then collected by the discharge conduits 94 and drained through the main drain conduit 95 and the drain 96. During such flushing operation, flushing water will also flow downwardly through the filter trays 64 and the holes 66 in the floors 65 finally to be collected in the collector tray 69 from which it can be discharged to waste through the drain outlet 97.

It will further be understood that, by continuously passing cooling water through the hollow component structures of the combustion chamber 12 and the gas-scrubbing chamber 16, those structures will be maintained at much lower temperatures than is the case with previously known incinerating devices. Consequently, such structures will suffer thermal damage or degradation to a much lower extent than with known incinerators. Furthermore, when such structural components do actually require replacement, after an extended period of use, such replacement does not require complete reconstruction of the entire combustion chamber and gas-scrubbing chamber. Frequently, all that will be necessary will be to replace the inner structural members which are actually exposed on their inner surfaces to the actual combustion flame.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. An incinerating device of metallic construction and which comprises:

a combustion chamber having upstanding metallic wall structures, each being formed by mutually spaced apart inner and outer metallic wall members and an overhead metallic roof structure formed by mutually spaced apart upper and lower metallic roof members;

a metallic door structure mounted on said combustion chamber for movement between a closed position and an open position for the introduction into said combustion chamber of material to be incinerated and formed by mutually spaced apart inner and outer metallic door members;

a hearth means within said combustion chamber for supporting material being incinerated within said chamber;

burner means associated with said hearth means within said combustion chamber for incinerating material within said chamber;

fuel supply means connected to said burner means for supplying fuel thereto;

grate means within said combustion chamber below said hearth means for receiving solid combustion products during incineration of material within said combustion chamber;

at least one cooling water supply means associated with said combustion chamber for supplying water to the spaces between said inner and outer wall members, the space between said upper and lower roof members and the space between said inner and outer door members;

at least one cooling water discharge means associated with said combustion chamber for discharging cooling water after its passage through the spaces between said inner and outer wall members, the space between said upper and lower roof members and the space between said inner and outer door members of said combustion chamber;

at least one first recirculating means for recirculating cooling water from said cooling water discharge means to said cooling water supply means;

a gas-scrubbing chamber connected to said combustion chamber for receiving combustion gases therefrom;

water spray means in said gas-scrubbing chamber for discharging water through said combustion gases passing through said gas-scrubbing chamber;

scrubbing water supply means associated with said water spray means for supplying gas-scrubbing water thereto;

filter tower means connected to said gas-scrubbing chamber for receiving both scrubbed combustion gases and scrubbing water from said gas-scrubbing chamber at an upper end of said filter tower means;

gas discharge means at an elevated position in said filter tower means for the discharge of scrubbed combustion gases from said filter tower means;

filter means in said filter tower means for filtering scrubbing water falling downwardly therethrough;

scrubbing water discharge means in said filter tower means for the discharge of filtered scrubbing water therefrom;

second recirculating means connecting said scrubbing water discharge means in said filter tower means to said scrubbing water supply means for transporting filtered scrubbing water to said water spray means;

flushing means associated with said filter means for discharging water to said filter means to dislodge solid material therefrom; and waste water discharge means in said filter tower for discharging waste water containing solid material therefrom.

2. An incinerating device as claimed in claim 1 and in which said inner and outer wall members, said upper and lower roof members and said inner and outer door members of said combustion chamber are all formed from a sheet metal material.

3. An incinerating device as claimed in claim 2 and in which said door structure is pivotally mounted in one of said wall structures of said combustion chamber for movement between said open and closed positions.

4. An incinerating device as claimed in claim 3 and in which said door structure is pivotally mounted in said one of said wall structures for movement between a generally vertical said closed position and a lowered said open position in which said door structure provides a loading ramp for discharging the material to be incinerated into said combustion chamber.

5. An incinerating device as claimed in claim 4 and in which said grate means is adapted for movement between a closed position for supporting solid combustion products thereon and an open position permitting such solid combustion products to fall downwardly therethrough.

6. An incinerating device as claimed in claim 5 and in which said grate means comprises a plurality of grate bars pivotally mounted for movement between first positions in which first surfaces of said grate bars cooperate to provide a surface for supporting solid combustion products thereon and second positions in which said first surfaces are inclined so to provide discharge openings between said grate bars.

7. An incinerating device as claimed in claim 2 and in which said gas-scrubbing chamber slopes downwardly toward said filter tower means whereby said scrubbing water flows gravitationally to said filter tower means.

8. An incinerating device as claimed in claim 7 and which additionally comprises blower means for driving said combustion gases through said gas-scrubbing chamber.

9. An incinerating device as claimed in claim 7 and in which said gas-scrubbing chamber is of metallic construction and is defined by metallic wall structures each being formed by mutually spaced apart inner and outer metallic wall members, a metallic roof structure formed by mutually spaced apart upper and lower metallic roof members and said base structure in turn formed by mutually spaced apart upper and lower metallic base members, the spaces between said inner and outer wall members, said upper and lower roof members and said upper and lower base members of said gas-scrubbing chamber being associated with said cooling water supply means and said cooling water discharge means for the passage of cooling water through said spaces.

10. An incinerating device as claimed in claim 2 and in which said filter means comprises a plurality of downwardly sloping and vertically spaced apart filter trays disposed so that scrubbing water flows sequentially across and downwardly through said trays falling downwardly from each said filter tray to the next said tray therebelow, said filter trays being effective to separate solid material from said scrubbing water flowing therethrough.

11. An incinerating device as claimed in claim 2 and which additionally comprises heat exchanger means in said first recirculating means for cooling water flowing therethrough.

12. An incinerating device as claimed in claim 1 and in which said flushing means comprises rotating spray means adapted to discharge water upwardly through said filter means.

* * * * *